US005232808A

United States Patent [19]

Bonser et al.

[11] Patent Number: 5,232,808

[45] Date of Patent: Aug. 3, 1993

[54] ELECTROSTATOGRAPHIC TONER AND DEVELOPER CONTAINING A FLUORINATED BETA-DIKETONE METAL COMPLEX CHARGE-CONTROL AGENT

[75] Inventors: Steven M. Bonser, Sudbury, Mass.; John C. Wilson, Rochester, N.Y.

[73] Assignee: Eastman Kodak Company, Rochester, N.Y.

[21] Appl. No.: 811,320

[22] Filed: Dec. 20, 1991

[51] Int. Cl.[5] ..... G03G 9/00; G03G 5/00

[52] U.S. Cl. ..... 430/110; 430/106; 430/109; 430/137

[58] Field of Search ..... 430/106, 109, 110, 137

[56] References Cited

U.S. PATENT DOCUMENTS 4,221,687 9/1980 Minagawa et al. ..... 260/23 X
4,556,621 12/1985 Hoffmann et al. ..... 430/49
5,028,724 7/1991 Ivankovits et al. ..... 556/40

FOREIGN PATENT DOCUMENTS 57-079964 5/1982 Japan .
61-212852 9/1986 Japan .

*Primary Examiner*—Marion E. McCamish
*Assistant Examiner*—Stephen C. Crossan
*Attorney, Agent, or Firm*—Nixon, Hargrave, Devans and Doyle

[57] ABSTRACT

Electrostatographic toners and developers are provided containing styrene-acrylic copolymer binders and charge-control agents comprising fluorinated $\beta$-diketone metal complexes having the structure:

(III)

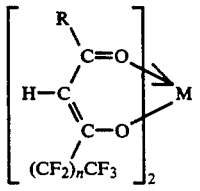

where
R is alkyl or aryl,
M is calcium, barium or zinc, and
n is a positive number up to 7

15 Claims, No Drawings

ELECTROSTATOGRAPHIC TONER AND DEVELOPER CONTAINING A FLUORINATED BETA-DIKETONE METAL COMPLEX CHARGE-CONTROL AGENT

FIELD OF THE INVENTION

This invention relates to electrostatographic toners and developers containing fluorinated B-diketone metal complexes as charge-control agents. Such complexes can be readily dispersed in typical styrene-acrylic copolymer toner binder materials to form inventive toners having good charging properties. The complexes are substantially colorless materials which make them particularly useful in colored toner and developer compositions.

BACKGROUND

In electrostatography an image comprising an electrostatic field pattern, usually of non-uniform strength, (also referred to as an electrostatic latent image) is formed on an insulative surface of an electrostatographic element by any of various methods. For example, the electrostatic latent image may be formed electrophotographically (i.e., by imagewise Photo-induced dissipation of the strength of portions of an electrostatic field of uniform strength previously formed on a surface of an electrophotographic element comprising a photoconductive layer and an electrically conductive substrate), or it may be formed by dielectric recording (i.e., by direct electrical formation of an electrostatic field pattern on a surface of a dielectric material). Typically, the electrostatic latent image is then developed into a toner image by contacting the latent image with an electrostatographic developer. If desired, the latent image can be transferred to another surface before development.

One well-known type of electrostatographic developer comprises a dry mixture of toner particles and carrier particles. Developers of this type are commonly employed in well-known electrostatographic development processes such as cascade development and magnetic brush development. The particles in such developers are formulated such that the toner particles and carrier particles occupy different positions in the triboelectric continuum, so that when they contact each other during mixing to form the developer, they become triboelectrically charged, with the toner particles acquiring a charge of one polarity and the carrier particles acquiring a charge of the opposite polarity. These opposite charges attract each other such that the toner particles cling to the surfaces of the carrier particles. When the developer is brought into contact with the latent electrostatic image, the electrostatic forces of the latent image (sometimes in combination with an additional applied field) attract the toner particles, and the toner particles are pulled away from the carrier particles and become electrostatically attached imagewise to the latent image-bearing surface. The resultant toner image can then be fixed in place on the surface by application of heat or other known methods (depending upon the nature of the surface and of the toner image) or can be transferred to another surface, to which it then can be similarly fixed.

A number of requirements are implicit in such development schemes. Namely, the electrostatic attraction between the toner and carrier particles must be strong enough to keep the toner particles held to the surfaces of the carrier particles while the developer is being transported to and brought into contact with the latent image, but when that contact occurs, the electrostatic attraction between the toner particles and the latent image must be even stronger, so that the toner particles are thereby pulled away from the carrier particles and deposited on the latent image-bearing surface. In order to meet these requirements for proper development, the level of electrostatic charge on the toner particles should be maintained within an adequate range.

The toner particles in dry developers often contain material referred to as a charge agent or charge-control agent, which helps to establish and maintain toner charge within an acceptable range. Many types of charge-control agents have been used and are described in the published patent literature.

One type of material that has been used in the prior art as a charge-control agent is a $\beta$-diketone metal complex. For example, Japanese Patent Application No. 80/156325, filed Nov. 6, 1980 (published unexamined Application [Kokai] No. 57/079964, laid-open May 19, 1982 describes an electrostatographic developing process which employs a positive charging single component developer containing a $\beta$-diketone metal complex that can be represented by the structure:

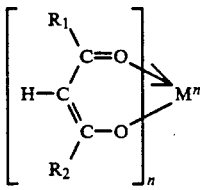

(I)

where $R_1$ and $R_2$ are alkyl, and $M^n$ is an n-valent metal.

Japanese Patent Application No. 85/53348, filed Mar. 19, 1985 (published unexamined application [Kokai] 61/212852, laid-open Sep. 20, 1986) describes an electrostatographic toner comprising as a charge-control agent a metal complex of a $\beta$-diketone represented by the structure:

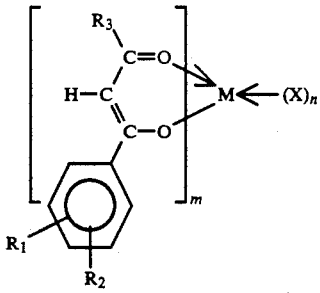

(II)

where $R_1$ and $R_2$ are hydrogen, halogen, alkyl, aralkyl, alkoxy, aryloxy, aralkyloxy, alkylthio, arylthio, aralkylthio or nitro in which $R_1$ and $R_2$ may be same or different and $R_1$ and $R_2$ together may form a substituted or unsubstituted ring; $R_3$ is alkyl, aryl or aralkyl; the alkyl or aryl in each of $R_1$, $R_2$ and $R_3$ may be substituted; M is metal; X is a neutrally coordinated molecule; m is an integer of 1 to 3; and n is an integer of 0, 2 or 4.

Unfortunately, many of the prior art known charge-control agents, including the $\beta$-diketone metal complexes described in the aforementioned Japanese patent applications exhibit significant drawbacks. For example, such charge agents often fail to provide sufficient initial charge of a desired negative or positive polarity or to maintain such charge for adequate development throughout the development process. In addition, certain charge control agents are highly colored and often impart an undesirable color to the toner which is objectionable in colored developers.

Also, poor dispersibility of some charge agents in some of the known toner binder materials can exacerbate some of the problems mentioned hereinbefore. Non-uniform dispersion of charge agent means that higher concentrations or agglomerations of charge agent will exist in some portions of the toner binder mix, compared to others. In typical melt-blending processes, the toner mixture is cooled and ground down to desired particle size after melt-blending. Agglomerations of charge agent provide sites in the mixture where fracture is more likely to occur during grinding. The new surfaces created by such fracture will have a higher concentration of charge agent than will internal sites. Thus, the final toner particles will have a higher surface concentration of charge agent than internal concentration. It should be readily appreciated that if a charge agent tends to adversely interact with the environment, higher surface concentrations of charge agent on the toner particles will lead to a greater degree of such interaction, thus exacerbating such problems as high environmental sensitivity.

It would, therefore, be desirable to provide new electrostatographic toners and developers that could perform the charge-controlling function well, while avoiding or minimizing the drawbacks noted hereinbefore. The objective of this invention is to provide such electrostatographic toners and developers.

SUMMARY OF THE INVENTION

The invention provides dry, particulate, electrostatographic toners and developers containing charge-control agents comprising a fluorinated $\beta$-diketone metal complex having the structure:

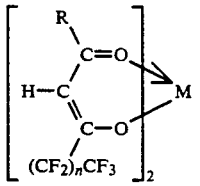

(III)

where

R is alkyl or aryl,

M is calcium, barium or zinc, and n is a positive number up to 7

The inventive toners comprise a styrene-acrylic copolymer binder and a charge-control agent chosen from the complexes defined above.

The inventive developers comprise carrier particles and the inventive particulate toner defined above.

DETAILED DESCRIPTION OF THE INVENTION

As indicated in the Summary of the Invention, R in the aforementioned calcium, barium or zinc complex is alkyl or aryl. Typically, such alkyl radicals can be straight-chain or branched and include lower alkyl radicals containing up to 4 carbon atoms as exemplified by methyl, ethyl, isopropyl and n-butyl. R can, however, be higher alkyl having up to 20 or more carbon atoms such as octyl, decyl, dodecyl, tetradecyl and octadecyl. Typical aryl radicals include phenyl, p-methylphenyl and p-ethylphenyl. The perfluoroalkyl radials contain up to 8 carbon atoms, as exemplified by perfluoromethyl, perfluoropropyl, perfluoropentyl and perfluoroheptyl. Examples of fluorinated $\beta$-diketone metal complexes useful as charge-control agents according to this invention are bis(1,1,1,2,2,3,3-heptafluoro-7,7-dimethyl-4,6-octanedion ato) zinc, bis(1,1,1,2,2,3,3-heptafluoro-7,7-dimethyl-4,6-octanedion ato) calcium bis(1,1,1,2,2,3,3-heptafluoro-7,7-dimethyl-4,6-octanedion ato) barium, bis(1,1,1,2,2,3,3-heptafluoro-6-(4-methylphenyl)-4,6-hexa nedionato) zinc, bis(1,1,1,2,2,3,3-heptafluoro-4,6-heptanedionato) zinc, bis(1,1,1,2,2,3,3-heptafluoro-6-(2-naphthyl)-4,6-hexanedi onato) zinc, bis(1,1,1,2,2,3,3-heptafluoro-6-phenyl-4,6-hexanedionato) zinc, bis(1,1,1,2,2-pentafluoro-6,6-dimethyl-3,5-heptanedionato zinc, bis(1,1,1,2,2,3,3,4,4,5,5,6,6,7,7,8,8,9,9-nonadecafluoro-13,13-dimethyl-10,12-tetradecanedionato) zinc, bis(1,1,1,2,2,3,3-heptafluoro-4,6-octanedionato) zinc, bis(1,1,1,2,2,3,3-heptafluoro-8-methyl-4,6-nonanedionato) zinc, bis(1,1,1,2,2,3,3,4,4,5,5,6,6-tridecafluoro-10,10-dimethyl-7,9-undecanedionato) calcium, bis(1,1,1,2,2,3,3,4,4,5,5,6,6,7,7-pentadecafluoro-11,11-dimethyl-8,10-dodecanedionato) barium.

The fluorinated $\beta$-diketone metal complexes employed in the practice of this invention as charge-control class of compounds and can be prepared using any one of a number of techniques known to be suitable for preparing such compounds. They are often prepared in the form of the hydrate and can conveniently be used in this invention in such form or an equivalent thereof. Several specific compounds and their preparation are disclosed in U.S. Pat. No. 4,221,687, issued Sep. 9, 1980, which is incorporated herein by reference.

To be utilized as a charge-control agent in the electrostatographic toners of the invention, the fluorinated B-diketone metal complex is mixed in any convenient manner, preferably by melt-blending as described, for example, in U.S. Pat. Nos. 4,684,596 and 4,394,430, with an appropriate styrene-acrylic copolymer toner binder material and any other desired addenda, and the mix is then ground to desired size to form a free-flowing powder of toner particles containing the charge agent.

Toner particles of the invention have an average diameter between about 0.1 $\mu$m and 100 $\mu$m, a value in the range from about 1.0 to 30 $\mu$m being preferable for many currently used copy machines. However, larger or smaller particles may be needed for particular methods of development or development conditions.

Generally, it has been found desirable to add from about 0.05 to 6 parts and preferably about 0.05 to 2.0 parts by weight of the aforementioned complex per 100 parts by weight of a styrene-acrylic copolymer binder to obtain the improved toner composition of the present invention. Although larger or smaller amounts of a charge-control agent can be added, it has been found that if amounts much lower than those specified above are utilized, the charge-control agent tends to exhibit little or substantially no improvement in the properties of the toner composition. As amounts more than about 6 parts of charge-control agent per 100 parts of polymeric binder are added, it has been found that the net toner charge exhibited by the resultant toner composition tends to be reduced. Of course, it must be recognized that the optimum amount of charge-control agent to be added will depend, in part, on the particular complex charge-control agent selected and the particular polymeric binder to which it is added. However, the amounts specified hereinabove are typical of the useful range of charge-control agent utilized in conventional dry toner materials.

The styrene-acrylic copolymers useful as toner binders in the practice of the present invention can be used alone or in combination and include those copolymers conventionally employed in electrostatic toners. Useful copolymers generally have a glass transition temperature within the range of from 50° to 120° C. Preferably, toner particles prepared from these copolymers have relatively high caking temperature, for example, higher than about 60° C., so that the toner powders can be stored for relatively long periods of time at fairly high temperatures without having individual particles agglomerate and clump together. The melting point of useful copolymers preferably is within the range of from about 65° C. to 200° C. so that the toner particles can readily be fused to a conventional paper receiving sheet to form a permanent image. Especially preferred copolymers are those having a melting point within the range of from about 65° C. to 120° C. Of course, where other types of receiving elements are used, for example, metal plates such as certain printing plates, polymers having a melting point and glass transition temperature higher than the values specified above can be used.

Among the various copolymers which can be employed in the toner particles of the present invention are copolymers of styrene or a styrene homolog such as methyl styrene with an addition polymerizable acrylic comonomer. Such polymers can comprise, e.g., a polymerized blend of from about 40 to 95 percent by weight of styrene, from about 5 to 60 percent by weight of a lower alkyl acrylate or methacrylate having from 1 to about 4 carbon atoms in the alkyl moiety such as methyl, ethyl, isopropyl, and n-butyl and from about 0 to 50 percent by weight of another vinyl monomer other than styrene, for example, a higher alkyl acrylate or methacrylate having from about 6 to 20 or more carbon atoms in the alkyl group. Typical styrene-acrylic copolymers prepared from a copolymerized blend as described hereinabove are copolymers prepared from a monomeric blend of 40 to 60 percent by weight styrene or styrene homolog, from about 20 to 50 percent by weight of a lower alkyl acrylate or methacrylate and from about 5 to 30 percent by weight of a higher alkyl acrylate or methacrylate such as ethylhexyl acrylate (e.g., poly(styrene-co-butyl acrylate-co-ethylhexyl acrylate). Preferred fusible styrene-acrylic copolymers are those which are covalently crosslinked with a small amount of a divinyl compound such as divinylbenzene. A variety of other useful styrene-acrylic copolymers containing toner materials are disclosed in U.S. Pat. Nos. 2,917,460; Re 25,316; 2,788,288; 2,638,416; 2,618,552 and 2,659,670.

Various kinds of well-known addenda (e .g., colorants, release agents, etc.) can also be incorporated into the toners of the invention.

Numerous colorant materials selected from dyestuffs or pigments can be employed in the toner materials of the present invention. Such materials serve to color the toner and/or render it more visible. Of course, suitable toner materials having the appropriate charging characteristics can be prepared without the use of a colorant material where it is desired to have a developed image of low optical density. In those instances where it is desired to utilize a colorant, the colorant can, in principle, be selected from virtually any of the compounds mentioned in the Colour Index Volumes 1 and 2, Second Edition. As previously indicated, the fluorinated $\beta$-diketone metal complexes employed in the practice of this invention are virtually colorless which makes them particularly useful in processes for preparing colored images.

Included among the vast number of useful colorants are those dyes and/or pigments that are typically employed as blue, green, red and yellow colorants in electrostatographic toners used to make color copies. In contrast to black toners, the toners containing such colorants reflect light in the visible region of the spectrum. Examples of useful colorants are such materials as Hansa Yellow G (C. I. 11680), Nigrosine Spirit soluble (C. I. 50415), Chromogen Black ETOO (C. I. 45170), Solvent Black 3 (C. I. 26150), Fuchsine N (C. I. 42510), C. I. Basic Blue 9 (C. I. 52015). The amount of colorant added may vary over a wide range, for example, from about 1 to 20 percent of the weight of the copolymer. Particularly good results are obtained when the amount is from about 1 to 10 percent.

To be utilized as toners in the electrostatographic developers of the invention, toners of this invention can be mixed with a carrier vehicle. The carrier vehicles, which can be used with the present toners to form the new developer compositions, can be selected from a variety of materials. Such materials include carrier core particles and core particles overcoated with a thin layer of film-forming resin.

The carrier core materials can comprise conductive, non-conductive, magnetic, or non-magnetic materials. For example, carrier cores can comprise glass beads; crystals of inorganic salts such as aluminum Potassium chloride; other salts such as ammonium chloride or sodium nitrate; granular zircon; granular silicon; silicon dioxide; hard resin particles such as poly(methyl methacrylate); metallic materials such as iron, steel, nickel, carborundum, cobalt, oxidized iron; or mixtures or alloys of any of the foregoing. See, for example, U.S. Pat. Nos. 3,850,663 and 3,970,571. Especially useful in magnetic brush development schemes are iron particles such as porous iron particles having oxidized surfaces, steel particles, and other "hard" or "soft," ferromagnetic materials such as gamma ferric oxides or ferrites, such as ferrites of barium, strontium, lead, magnesium, or aluminum. See, for example, U.S. Pat. Nos. 4,042,518; 4,478,925; and 4,546,060.

As noted above, the carrier particles can be overcoated with a thin layer of a film-forming resin for the Purpose of establishing the correct triboelectric relationship and charge level with the toner employed. Examples of suitable resins are the polymers described in U.S. Pat. Nos. 3,547,822; 3,632,512; 3,795,618 and 3,898,170 and Belgian Patent No. 797,132. Such polymeric fluorohydrocarbon carrier coatings can serve a number of known purposes. One such purpose can be to aid the developer to meet the electrostatic force requirements mentioned above by shifting the carrier Particles to a position in the triboelectric series different from that of the uncoated carrier core material, in order to adjust the degree of triboelectric charging of both the carrier and toner particles. Another purpose can be to reduce the frictional characteristics of the carrier Particles in order to improve developer flow Properties. Still another purpose can be to reduce the surface hardness of the carrier particles so that they are less likely to break apart during use and less likely to abrade surfaces (e.g., photoconductive element surfaces) that they contact during use. Yet another purpose can be to reduce the tendency of toner material or other developer additives to become undesirably permanently adhered to carrier surfaces during developer use (often referred to as scumming). A further purpose can be to alter the electrical resistance of the carrier particles.

A typical developer composition containing the above-described toner and a carrier vehicle generally comprises from 1 to about 20 percent by weight of particulate toner particles and from 80 to about 99 percent by weight carrier particles. Usually, the carrier particles are larger than the toner particles. Conventional carrier particles have a particle size on the order of from 20 to about 1200 microns, preferably 30–300 microns.

Alternatively, the toners of the present invention can be used in a single component developer, i.e., with no carrier particles.

The toner and developer compositions of this invention can be used in a variety of ways to develop electrostatic charge patterns or latent images. Such developable charge patterns can be prepared by a number of means and be carried for example, on a light sensitive photoconductive element or a non-light-sensitive dielectric-surfaced element such as an insulator-coated conductive sheet. One suitable development technique involves cascading the developer composition across the electrostatic charge Pattern, while another technique involves applying toner particles from a magnetic brush. This latter technique involves the use of a magnetically attractable carrier vehicle in forming the developer composition. After imagewise deposition of the toner particles, the image can be fixed, e.g., by heating the toner to cause it to fuse to the substrate carrying the toner. If desired, the unfused image can be transferred to a receiver such as a blank sheet of copy paper and then fused to form a permanent image.

The following preparations, measurements, tests, and examples are presented to further illustrate some preferred embodiments of the toners and developers of the invention and the charge agents employed therein.

Where toner charge in a developer is indicated, usually as microcoulombs per gram of toner particles (μc/g), the charge was determined by a technique referred to as the "MECCA" method, wherein the apparatus consists of two parallel metal plates separated by insulating posts about 1 cm high. An AC electromagnet is located beneath the lower plate to provide magnetic agitation, while a DC electric potential of about 2000 volts can be applied across the plates. A sample of about 0.2 gram of developer is weighed, placed on the lower plate, and charged by magnetic agitation for 30 seconds. Next, both the electric and magnetic fields are applied for 30 seconds. The toner is separated from the carrier by the combined agitation and electric field and is transported to the upper plate by the electric field. The charge on the toner collected by the top plate is measured in microcoulombs by an electrometer, and the weight of toner is determined. The registered charge is divided by the weight of the plated toner to obtain the charge per mass of toner. Before testing, developer samples, at 12 weight per cent toner concentration, are exercised for 2 minutes and 10 minutes by tumbling in a glass bottle placed in the rotating magnetic field (2000 RPM) of a magnetic brush developing station.

Developer dusting or "throw-off", reported in milligrams, is performed with developer formed by mixing toner Particles with strontium ferrite carrier particles thinly coated with a resin. In making the test, a sample of developer (two minute exercise) is placed in a magnetic brush developer station which is connected by way of a filter to a vacuum source. As the magnets of the brush rotate and agitate the developer, toner which separates from the carrier is drawn off by the vacuum and collects on the filter. The weight of toner on the filter after one minute shows the extent of dusting or "throw-off" of toner.

EXAMPLE 1—STYRENE-ACRYLIC TONERS AND DEVELOPERS

Toners were formulated from 100 parts toner binder comprising poly(styrene-co-n-butyl acrylate-co-divinylbenzene), 1.0 or 2.0 parts of bis(1,1,1,2,2,3,3-heptafluoro-7,7-dimethyl-4,6-octanedion ato) zinc complex, and 5 parts blue pigment (Heliogen Blue NBD-7110, available from BASF Corp.). The formulations were melt-blended on a two-roll mill at 130° C., allowed to cool to room temperature, and coarse ground and fluid energy-milled to form toner particles. Developers were prepared by mixing the toner particles (at a concentration of 12% toner) with carrier particles comprising strontium ferrite cores coated with poly(methyl methacylate-co-t-butylstyrene) 95/5, weight percent. Developer charge and throw-off were determined as described previously herein and reported in the following Table 1.

TABLE 1

| Concentration (pph) | Charge (μc/g) 2 min. | Charge (μc/g) 10 min. | Throw-Off (mg.) |
|---|---|---|---|
| 1 | −10.3 | −37.4 | 2.3 |
| 2 | −11.6 | −37.9 | 2.0 |

The charge reported in the above Table for the 2 min. exercise illustrates that the inventive developers are capable of initially charging to a reasonably high level in a very short time. The above results also clearly demonstrate the low toner throw-off characteristic of the inventive toner which indicates that toner will not be lost to the system during the development Process which results in a more stable electrostatographic charge. The increase in charge with increasing charge-control agent concentration that is reported in the above Table also indicates that the charge-control agents used in this invention disperse well in the toner because previous experience has shown that a toner with a poorly dispersed charge-control agent will show decreased charge as charge-control agent concentration is increased.

To simulate toner replenishment in a conventional bias development process, samples of developer (at a toner concentration of 30%) were exercised for 24 hours by placing them in vials on top of a typical, normally rotating, magnetic brush development apparatus. The toner containing fluorinated zinc complex charge-control agent was then stripped from the carrier and developer samples were prepared by mixing the toner particles previously described in this Example 1 (at a toner concentration of 12%) with the stripped carrier particles. Developer charges and throw-off were determined as previously indicated herein, and reported in the following Table 2.

TABLE 2

| Concentration (pph) | Charge (μc/g) 2 min. | Charge (μc/g) 10 min. | Throw-Off (mg.) |
|---|---|---|---|
| 1 | −22.7 | −35.1 | 2.3 |
| 2 | −26.2 | −31.5 | 2.0 |

The charge and throw-off values reported in the above Table 2 indicate that the inventive toners and developers can be expected to retain charge stability and exhibit long life in conventional copying apparatus.

EXAMPLE 2

Developers were formulated according to the procedure of Example 1 except that bis(1,1,1,2,2,3,3-heptafluoro-7,7-dimethyl-4,6-octanedionato) calcium (CCA-1) or bis(1,1,1,2,2,3,3,-heptafluoro-7,7-dimethyl-4,6-octanedionato) barium (CCA-2) was used as the charge-control agent. Developer charge and throw-off were determined according to the Procedure of Example 1 and the results reported in the following Table 3.

TABLE 3

| Charge Control Agent | Concentration (pph) | Charge (μc/g) 2 min. | Charge (μc/g) 10 min. | Throw-Off (mg.) |
|---|---|---|---|---|
| CCA-1 | 1 | −9.3* | −36.7 | 4.7 |
| | 2 | −12.1 | −34.5 | 3.4 |
| CCA-2 | 1 | −9.3 | −40.5 | 3.8 |
| | 2 | −12.0 | −29.7 | 6.7 |

*bicharged

A comparison of the charge and throw-off values reported in the above Table 3 with those reported in Table 1 illustrates that Developers containing charge-control agents CCA-1 or CCA-2 can also be expected to exhibit excellent charge stability and long developer life and that such charge-control agents are well-dispersed in the toner binder.

EXAMPLE 3

As previously indicated herein, the inventive electrostatographic toners and developers represent a significant advance in comparison to prior art toners and developers that employ comparable B-diketone metal complexes, including those of the type described in Japanese published applications (Kokai) Nos. 57/079964 and 61/212852, referred to previously herein. To illustrate, the procedure of Example 1 was used to formulate black toners containing 5 parts of Regal 300 TM carbon black, available from Cabot Corp., and 1,2 and 5 pph. of (A) bis(1,1,1,2,2,3,3,-heptafluoro-7,7-dimethyl-4,6-octanedionato) zinc complex, (B) bis(1-phenyl-1,3,-butanedionato) zinc, (C) bis(1,1,1-trifluoro-4-phenyl-2,4-butanedionato) zinc or (D) bis(1,3-diphenyl-1,3-propanedionato) zinc. Developer charge and throw-off were determined with the aforementioned charge-control agents A–D as described in example 1 and reported in the following Table 4.

TABLE 4

| Charge Control Agent | Concentration (pph) | Charge (μc/g) 2 min. | Charge (μc/g) 10 min. | Throw-Off (mg.) |
|---|---|---|---|---|
| A (Invention) | 1 | −9.6 | −30.5 | 82.1 |
| | 2 | −10.6 | −27.2 | 30.6 |
| | 5 | −15.0 | −25.0 | 7.7 |
| B | 1 | −5.4 | −28.1 | 143.9 |
| | 2 | −5.3 | −26.5 | 96.1 |
| | 5 | −5.2 | −26.1 | 110.8 |
| C | 1 | −7.9 | −21.5 | 77.2 |
| | 2 | −10.7 | −21.4 | 39.9 |
| | 5 | −12.6 | −20.5 | 22.1 |
| D | 1 | −5.5 | −28.6 | 111.6 |
| | 2 | −5.3 | −25.8 | 131.9 |
| | 5 | −5.1 | −25.7 | 128.4 |

The charge and throw-off values reported in the above Table 4 demonstrate that the inventive developers generally achieve a higher initial charge in a short time (2 min. exercise) and maintain a higher charge (10 min. exercise) in comparison to B-diketone metal complexes having similar structures. In addition, the throw-off values for the inventive toners are much better than those of the comparison toners using charge-control agents B and D at all concentrations and better than those using charge-control agent C at the higher concentrations of 2 and 5 pph.

The invention has been described in detail with particular reference to certain preferred embodiments thereof, but it should be appreciated that variations and modifications can be effected within the spirit and scope of the invention.

What is claimed is:

1. A dry, particulate, electrostatographic toner composition comprising a styrene-acrylic copolymer binder and a charge-control agent comprising a fluorinated β-diketone metal complex having the structure:

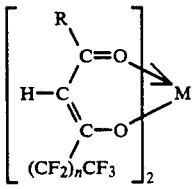

(III)

where

R is alkyl or aryl,

M is calcium, barium or zinc, and n is a positive number up to 7.

2. The toner composition of claim 1, wherein R is alkyl containing up to 4 carbon atoms and n is a number in the range of 2 to 4.

3. The toner composition of claim 2, wherein. M is zinc.

4. The toner composition of claim 2, wherein M is calcium.

5. The toner composition of claim 2 wherein M is barium.

6. The toner composition of claim 1, wherein the metal complex is bis(1,1,1,2,2,3,3-heptafluoro-7,7-dimethyl-4,6-octanedionato) zinc.

7. The toner composition of claim 2 wherein the metal complex is bis( 1,1,1,2,2,3,3,-heptafluoro-7,7-dimethyl-4,6-octanedionato) calcium.

8. The toner composition of claim 2 wherein the metal complex is bis(1,1,1,2,2,3,3-heptafluoro-7,7-dimethyl-4,6-octanedionato) barium 9. The toner composition of claim 2, wherein the binder is styrene-alkyl acrylate copolymer.

10. The toner composition of claim 3, wherein the binder is styrene-alkyl acrylate copolymer.

11. The toner composition of claim 3, wherein the binder is poly(styrene-co-n-butyl acrylate-co-divinylbenzene).

12. An electrostatographic developer comprising:

a. the particulate toner composition of claim 1 and b. carrier particles.

13. The electrostatographic developer of claim 12, wherein the particulate toner composition is a color toner composition comprising a colorant.

14. The electrostatographic developer of claim 13, wherein the colorant is a blue, green, red or Yellow colorant.

15. The electrostatographic developer of claim 14 wherein the colorant is a blue colorant.

* * * * *